US005823012A

United States Patent [19]

Hacskaylo

[11] Patent Number: 5,823,012

[45] Date of Patent: Oct. 20, 1998

[54] JACQUARD KNIT PATTERNED WRISTBAND AND HEADBAND AND METHODS OF MAKING SAME

[75] Inventor: Charles A. Hacskaylo, Asheboro, N.C.

[73] Assignee: Pine Hosiery Mills, Inc., Star, N.C.

[21] Appl. No.: 754,228

[22] Filed: Nov. 20, 1996

[51] Int. Cl.[6] ..... D04B 1/12; A41D 19/00

[52] U.S. Cl. ..... 66/171; 66/180; 2/170; 2/DIG. 11

[58] Field of Search ..... 66/180, 170, 171; 2/170, 171, DIG. 11

[56] References Cited

U.S. PATENT DOCUMENTS

| | | | |
|---|---|---|---|
| 215,671 | 5/1879 | Quosbarth | 2/170 |
| 2,241,901 | 5/1941 | Davis | 66/180 X |
| 2,468,668 | 4/1949 | Holmes | 66/180 |
| 2,643,389 | 6/1953 | Wegner | 2/170 |
| 2,873,592 | 2/1959 | Larkin | 66/15 |
| 2,934,921 | 5/1960 | Green | 66/180 |
| 3,184,758 | 5/1965 | Hirsch . | |
| 4,047,400 | 9/1977 | Thorneburg | 2/170 X |
| 4,499,741 | 2/1985 | Harris | 66/171 |
| 4,517,685 | 5/1985 | Lesley | 2/DIG. 11 |
| 4,521,922 | 6/1985 | Mitchell et al. | 2/171 |
| 4,843,653 | 7/1989 | Coble | 2/170 |
| 5,125,116 | 6/1992 | Gaither | 66/180 X |
| 5,305,470 | 4/1994 | McKay | 2/7 |
| 5,471,683 | 12/1995 | Moretz et al. | 2/181 |

FOREIGN PATENT DOCUMENTS

| | | | |
|---|---|---|---|
| 2052355 | 3/1993 | Canada | 2/DIG. 11 |

*Primary Examiner*—John J. Calvert
*Attorney, Agent, or Firm*—Bell Seltzer Intellectual Property Law Group of Alston & Bird, LLP

[57] ABSTRACT

An athletic band structure having a knitted-in distinct design and a method of manufacturing such a band are described. The athletic bands are knit using a jacquard patterning mechanism to form a patterned tubular structure having one or more individual courses, each of which have adjacent wales knit from visually distinct yarns. The tubular structure is formed into a finished band in one of several ways. In one method of the invention, the patterned tubular structure is folded axially and seamed to form a double layer structure. The seam can then be repositioned to a central portion of the athletic band where it is not visible when the band is worn. In the production of a high performance embodiment of the invention, upper and lower sections of the patterned tubular structure are knit from a specialty yarn such as a wicking or insulating yarn, which results in the completed athletic band having superior moisture absorption capabilities as well as an integrally formed design. In another method of the invention particularly useful in the production of headbands, a small diameter tubular structure is knit using a jacquard patterning mechanism to integrally form a defined design by causing one or more individual courses to have adjacent wales knit from visually distinct yarns. Opposite ends of the tubular structure are then secured together, to form a finished dual layer headband. In this form of the invention, a plurality of adjacent wales can be knit from a specialty performance yarn along one side of the tubular structure, to thereby form a headband which has superior performance capabilities as well as a defined integral design.

10 Claims, 3 Drawing Sheets

JACQUARD KNIT PATTERNED WRISTBAND AND HEADBAND AND METHODS OF MAKING SAME

FIELD OF THE INVENTION

This invention relates generally to an athletic band construction, and a method of making the same. More specifically, the invention relates to headband and wristband constructions having integrally formed design patterns, and methods of producing the same.

BACKGROUND OF THE INVENTION

Athletic bands such as headbands and wristbands are frequently used for a variety of performance as well as ornamental purposes. For example, tennis players, basketball players, football players and the like commonly wear some type of absorbent wristband to absorb moisture from their wrists and for use in wiping moisture from other portions of their bodies such as their foreheads. Because such bands are used to absorb large amounts of liquids, they are desirably very absorbent. In addition, in order that they can be properly applied (e.g. extended over a wearer's hand and onto the wrist), they must either have sufficient elasticity to stretch while being donned, then retract into the wear position, or they must have releasable fasteners which enable them to be opened and fastened around the appropriate portion of the wearer's body. Further, the band must be stretchable and/or the fasteners adjustable if the athletic bands are to accommodate wearers of various proportions. However, because the regulations of many sports limit the use of hard fasteners which could injure an athlete or his opponents, the use of releasable fasteners can be limited in many athletic environments. Thus, such bands are typically manufactured from knitted terry cloth fabrics, since it has been found that such fabrics can be manufactured to be both absorbent and sufficiently elastic to allow donning without the need for extraneous fasteners.

Because athletes wear only a limited number of garments during participation in various sports, advertisers see virtually any visible item worn by an athlete as an advertising opportunity. As a result, top athletes are often paid large amounts of money to wear items which display the logo of a specific company. Similarly, the athletes, team owners and fans like to maximize the display of their team name and logo, in order to show support for their team. As a result, ornamented sports apparel has become a popular expression of fashion and commercial advertisement as well as team loyalty.

Heretofore, however, athletic bands have not been a particularly good vehicle for advertising or other indicia display, since the terry cloth and similar stretch materials used to manufacture such bands do not tend to provide a good medium for supporting such indicia. To ornament conventional bands with indicia, the designs are generally either embroidered or screen printed onto the band. The embroidery process, while providing moderately distinct designs, tends to be expensive to perform, and thus significantly increases the cost of such bands. Further, because the embroidery thread typically is inelastic and is sewn into the band very tightly, it tends to limit the stretch of the band dramatically in the locations where it appears. Additionally, in the case of terry cloth bands, the embroidery process tends to pull the terry loops adjacent the design over top of the embroidered portions, thus obscuring the design. Further, not only is the absorptability of the terry loops which are covered by the embroidered design reduced or even lost, but the embroidered design portion of the band generally is relatively rough compared to the terry portion of the band, and can feel unpleasant to the wearer when used to wipe perspiration from portions of the wearer's body.

Other efforts at ornamenting athletic bands have been directed at screen printing a design onto the fabric forming the band, or onto the completed bands themselves. The screen printing process does not tend to provide a very distinct design, and the design tends to be distorted when the band is stretched, since the screen printed design is generally only bonded to the outer surface of the fabric. When a thick screen printing material is utilized to provide more complete fabric coverage and thus more distinct pattern, it tends to block the ability of the underlying portions of the band fabric to absorb and transfer moisture. Further, such screen printing materials generally provide an undesirable hand and tend to crack upon repeated bending, which inherently occurs as a result of the fabric being stretched when the band is donned by the wearer. As a result, the useful life of such screen printed bands tends to be undesirably short.

Examples of prior art attempts at providing ornamented athletic bands are described in U.S. Pat. Nos. 4,499,741 and 4,843,653 to Harris and Coble, respectively. The Harris patent describes a stretchable knitted athletic headband produced from a length of tubular circularly-knitted stretchable fabric which is folded upon itself and sewn together to form a tubular band structure. The major portion of the band is formed of single jersey construction having terry loops on the reverse side. A minor region of the band is of a reverse-side plain jersey construction, and the major and minor portions are integrally knit with each other. The plain knit region is oriented in the headband so that it only stretches in a course-wise direction during band use, in order to provide a relatively smooth surface onto which a design may be printed in a conventional manner, such as by screen printing.

The Coble patent describes a tubular band having a center region of absorbent terry knit material and first and second plain knit welt areas for securing the center region to a wearer's arm. The plain knit welt areas can be of one or two layer thickness and are described as providing surfaces for ornamental indicia. Thus, it would be desirable to have an athletic band construction which is a good vehicle for decorative indicia, while having good functional characteristics as well.

SUMMARY OF THE INVENTION

With the foregoing in mind, it is an object of the present invention to provide an athletic band construction which has an integral distinct design.

It is also an object of the invention to provide an athletic band which provides a high degree of moisture absorption.

An additional object of the present invention is the provision of an athletic band which has enhanced performance characteristics provided by the inclusion of specialty performance yarns in the band structure.

It is a further object of the present invention to provide a method for making an athletic band having an integral distinct design using only a minimal number of manufacturing steps.

These and other objects are met by the provision of a jacquard knit athletic band having an integrally knit design. Though specifically described as an "athletic band", it is noted that the term athletic and is intended to encompass all headband, wristband, and like structures, regardless of whether worn in an athletic environment or for ornamental purposes alone.

Conventional circular weft knitting machines which lack patterning capabilities are generally limited to a single yarn forming each individual course. (For purposes of this application, "single yarn" is intended to describe that the same yarn from a single feed forms the course, though that yarn can be a single ply or multi-ply yarn or a group of yarns, i.e. the singularly fed yarn can include plural yarns being fed as one to the needles.) Thus, where patterning via yarn variation in the fabric is desired, such machines are generally limited to fabric constructions such as striped jersey, where the fabric patterning occurs through the formation of successive complete courses which are formed from visually distinct yarns. In other words, such conventional machines generally are not capable of producing designed fabrics having adjacent wales in a single course knit from visually distinct yarns. Thus, knit fabrics produced on such machines, such as the terry fabrics used to form prior art athletic bands, have generally relied on means other than the knitting process itself for ornamentation.

In contrast, the athletic bands of the instant invention have a design which forms a part of the band fabric structure itself. The bands are knit using a jacquard patterning mechanism, which enables the yarn forming each individual course to be varied along the length of the knit course. Stated differently, adjacent wales in an individual course can be selectively knit from visually distinct yarns, to thereby provide a design which is integrally formed in the knit fabric and forms a part of the fabric itself.

The athletic bands thus can have a detailed distinct design while consistent absorption capabilities can be maintained across the complete outer band surface including those portions which are ornamented.

In one method of the invention, a small diameter circular knitting machine such as a sock machine is used to knit a jacquard tubular fabric. A patterning mechanism is utilized during the knitting process to select which yarn from a plurality of yarns presented will be fed to each needle on the knitting cylinder during each course being knit. In other words, the patterning mechanism determines which of a plurality of yarns offered will actually be fed to each individual needle in a predetermined manner, in order to form a predetermined pattern. As a result, adjacent wales in an individual course can be knit from yarns which are visually distinct from each other. Although the number of yarns which can be offered at each needle is limited by space considerations and the complexity of the pattern mechanism, a different variety of yarn choices can be presented at each course, if desired. Because the courses are formed successively one above the other, the number of yarn and pattern variations which can be achieved over the dimensions of the fabric are essentially limitless.

In this method of the invention, the tubular fabric is knit or cut to a length approximately twice as long as the desired length for the finished athletic band. The band is then folded axially upon itself such that the "right side" of the fabric forms the visible surfaces of the inner and outer tubes defined by the folded tubular structure, and the free ends of the tubes are secured together in a conventional manner, such as by sewing. In a preferred form of the invention, the seam formed by the securing together of the two ends of the tube is then positioned proximate a central portion of the inner tube, so that it is not readily visible when the band is worn.

In an embodiment of the invention which is particularly useful in sports environments, the tubular structure knit to form the band has a portion of its length formed from a specialty yarn designed to enhance particular performance characteristics of the band. In a preferred form of this embodiment, the tubular structure has a defined tubular length, with upper and/or lower sections of the tubular length being knit from a specialty yarn which provides enhanced moisture absorptive or thermal regulating characteristics to the finished band. In a form of this embodiment, the combined, tubular length of the upper and lower sections is approximately one half the total tubular length of the tubular structure. In this way, when the tubular structure is folded axially to define inner and outer nested tubes and the ends are secured together and positioned proximate a central portion of the inner tube, the specialty yarn forms a major portion of the inner wearer-contacting tube. For example, where a specialty moisture transfer yarn is used to form the portion of the tubular structure which forms the inner tube, the yarn can improve the wicking of moisture from a person's skin and transport it to the outer tube, where it can more readily evaporate.

In another form of the invention, a small diameter yet relatively long tubular structure is jacquard knit such that selected adjacent wales in one or more of the individual courses are knit from visually distinct yarns, to form a design in the tubular structure. The tubular structure is knit or cut to a length approximating that desired for the band being formed, and opposite ends of the structure are secured together to form a finished athletic band. In a form of this embodiment specifically designed for sports environments, a number of wales on one half of the tubular circumference of the knit tubular structure are knit from a specialty yarn, to provide enhanced characteristics such as increased adsorptiveness, moisture transfer or thermal regulating characteristics to one side of the band. In this way, when the tubular structure is formed into a finished athletic band, the side of the structure containing the specialty yarn can be positioned on the side of the athletic band where it will be most effective. For example, a wicking yarn can be used to form at least a portion of the skin-contacting side of the athletic band, in order that the ability of the athletic band to wick moisture away from the wearer's skin is enhanced.

BRIEF DESCRIPTION OF THE DRAWINGS

Other objects and advantages will appear as the description proceeds when taken in connection with the accompanying drawings, in which.

DETAILED DESCRIPTION

The present invention now will be described more fully hereinafter with reference to the accompanying drawings, in which various embodiments of the invention are shown. This invention may, however, be embodied in many different forms and should not be construed as limited to the illustrated embodiments set forth herein; rather, these illustrated embodiments are provided so that this disclosure will be thorough and complete, and will fully convey the scope of the invention to those skilled in the art. Like numbers refer to like elements throughout.

Figure 1:
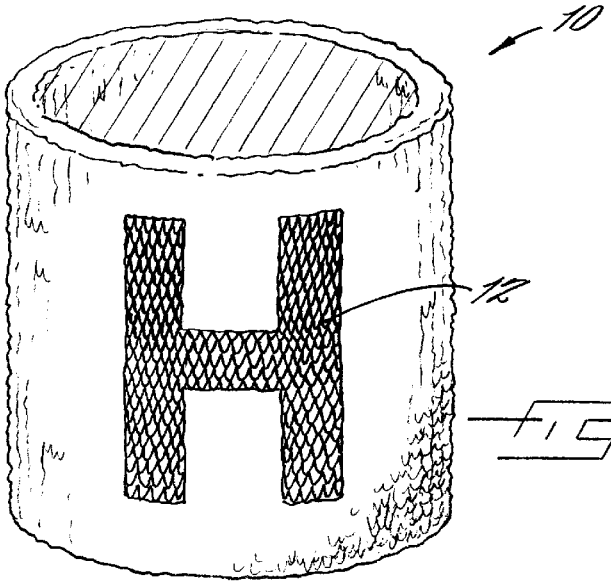
FIG. 1 is a perspective view of an athletic band according to the present invention.

FIG. 1 illustrates an athletic band according to the present invention, shown generally at 10. The band 10 includes a design 12 which forms a part of the knit fabric of the band. As illustrated, the design which forms a part of the band is defined by adjacent wales in individual knit courses being formed by visually distinct yarns. The visual distinctness of the yarns is preferably a result of the yarns being different colors though other types of visually distinct yarns can be used, including, but not limited to those which differ in size, luster, texture, fiber composition, and the like.

The design(s) formed in the athletic band 10 can have virtually any desired configuration. For example, a plurality of small repeating designs can be knit all over the surface of the band, or one or more larger designs could be used. Additionally, the inner or wearer contacting surface of the band can have the same or a different pattern from that of the outer facing surface, or it can be unornamented, if desired.

Figure 2:
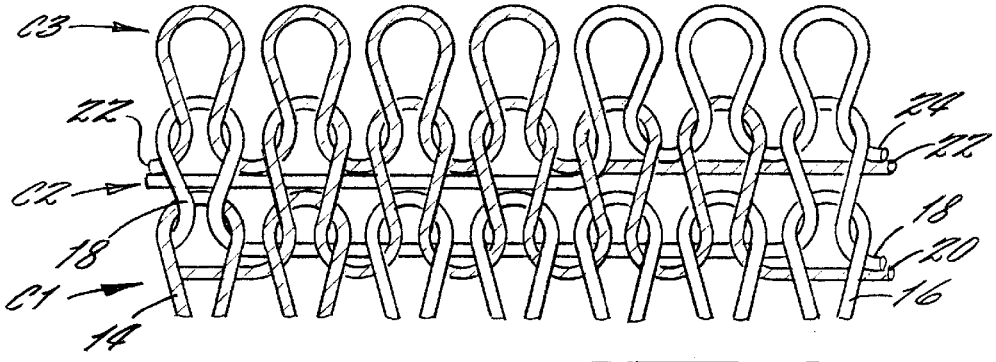
FIG. 2 is a greatly enlarged view of a section of the band of FIG. 1, illustrating the jacquard knit structure being used to form that band.

FIG. 2 is an enlarged view of the technical face of three knit courses C1, C2, and C3 of a section of the band 10, showing how the band is knit to include the design. As shown, course C1 is knit from a first yarn 14 and a second yarn 16, course C2 is knit from a first yarn 18 and second yarn 20, and course C3 is knit from a first yarn 22 and second yarn 24. The first and second yarns which form each of the respective courses C1, C2, and C3 are visually distinguishable from each other, for example, by being different in color, luster, size, texture, or the like. Although only two different yarns form the section of each course in the knitting sequence illustrated, it is noted that some courses may be knit from a single yarn, while others may be knit from two or more yarns in jacquard fashion in order to form individual courses having two or more visually distinct sections.

The yarn knit at each needle is selected by a jacquard patterning mechanism such as those conventionally used in the production of jacquard knit socks. The patterning mechanism selects which one of a plurality of yarns at the feeder will be fed to each individual needle, and positions the non-selected yarn(s) so that they form floats on the technical rear of the fabric. Because the patterning mechanism enables the yarns forming individual wales of each individual course to be varied, the patterning options for the athletic band are essentially limitless; and intricate designs with high definition can be obtained. Further, because the design is part of the fabric structure itself, an uninterrupted smooth band surface can be obtained, which has consistent absorptive capabilities across its entire dimension.

A method of making the athletic band 10 illustrated in FIG. 1 is illustrated in FIGS. 3–6. As shown, a tubular structure in the form of a band blank 30 is knit on a circular knitting machine, preferably to a length at least slightly greater than two times the length desired for the finished band 10. In a preferred form of the invention, the band blank includes a stretch yarn which is knit in with the body yarn in a plated relationship to provide enhanced stretch characteristics to the band. Similarly, the band could be knit entirely from stretch yarns. Though only a single band blank 30 is illustrated, it is noted that a plurality of blanks can be provided in series, which can be separated by cutting them apart or the like. Alternatively, a plurality of band blanks can be knit in series, with the bands being connected to each other by way of a retractable (e.g. pull yarn) or readily destructible (e.g. dissolvable) yarn. As a further alternative, the bands can each be knit with a non-raveling edge, with individual bands being strung together by a yarn, formed individually with each band blank being completely separate from the next, or in any conventional manner used for the mass production of knit articles.

Figure 5:
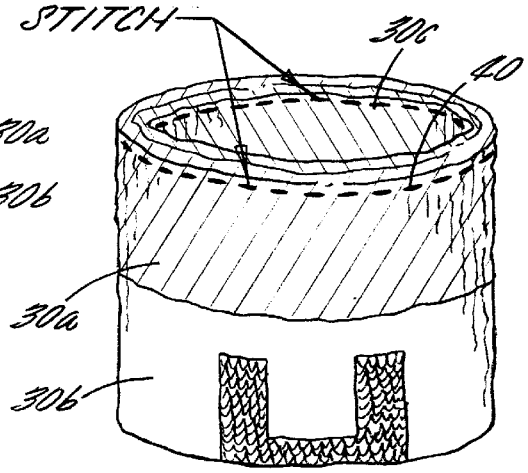
FIG. 5 is a perspective view of the blank of FIG. 4, as it appears with the free ends secured together.

The band blank 30 is jacquard knit such that adjacent wales in at least one individual course, and preferably in a number of courses, are knit from visually distinct yarns, in the manner illustrated in FIG. 2. The band blank 30 is then folded axially upon itself in the manner shown in FIG. 4, to form inner and outer tubes 34 and 36, respectively, which are positioned in a nesting relationship with the "right side" of the fabric of the band blank forming the exposed faces of each of the inner and outer tubes. The free ends 38 of the inner and outer tubes 34, 36 are aligned and secured together in a conventional manner to form a seam 40, as shown in FIG. 5, and to define a substantially ring-shaped pocket therebetween. For example, the inner and outer tubes can be secured together by sewing, adhesive attachment, by way of mechanical fasteners, etc. The seam 40 is then desirably positioned toward a central portion of the inner tube 34, so that it is not readily visible when the band 10 is worn.

In an embodiment of the invention described above which has enhanced performance characteristics, upper and/or lower sections 30*a* and 30*c* of the band blank 30 can be knit from a specialty yarn capable of providing the enhanced performance characteristics to the athletic band. For example, a thermal regulating yarn such as those sold under the trade names COOLMAX® and THERMAX® by DuPont, Inc. or a moisture wicking yarn could be used to form the upper and/or lower sections 30*a*, 30*c* of the band blank, in order to increase the moisture absorptive or insulting characteristics, respectively, of the athletic band. The central section 30*b* can be knit from whatever type of yarn the manufacturer desires to have form the outer visible band surface since in the band structure illustrated, the central section 30*b* of the band structure forms the surface of the athletic band which is remote from the portion of the wearer's body to which the band is secured. In a preferred form of the invention, the central portion 30*b* is knit from all or substantially all cotton yarns, since such yarns have good moisture absorbing capabilities. While in the embodiment illustrated the length of the upper and lower sections 30*a* and 30*c* are substantially equal (which would be the case when it is desired that the seam be positioned proximate the center of the inner tube 34), it is noted that the proportions of each of the sections 30*a*, 30*b* and 30*c* can be varied as desired. Where it is desired, however, that the specialty yarn form substantially the entire inner tube 34, it is desirable that the sum of the lengths of the upper and lower sections 30*a*, 30*c* be approximately equal to the length of the central portion 30*b*. Alternatively, the central section 30*b* can be formed from a specialty yarn, with the upper and/or lower sections 30*a*, 30*c* being formed from a different type of yarn. As a further alternative, the entire band blank 30 could be knit from a specialty yarn or combination thereof. Similarly, the inner and outer tubes 34, 36 can be knit to have the same design therein, or to have contrasting or coordinating designs, depending on the desires of the manufacturer.

Figure 3:
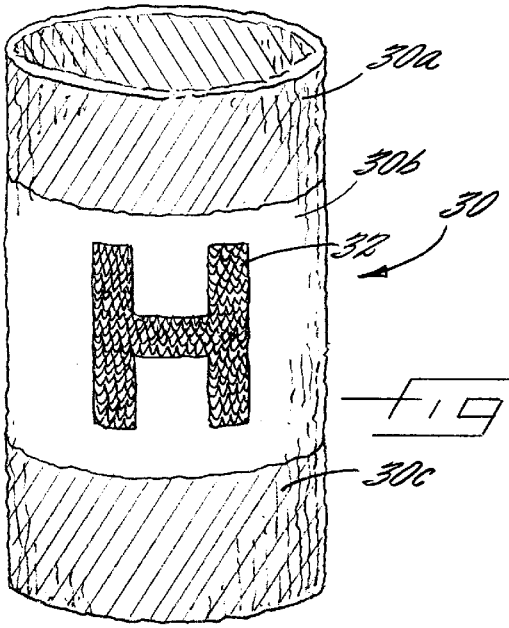
FIG. 3 is a perspective view of a "right-side out" knit blank used to form the athletic band of FIG. 1 according to the instant invention.
Figure 4:
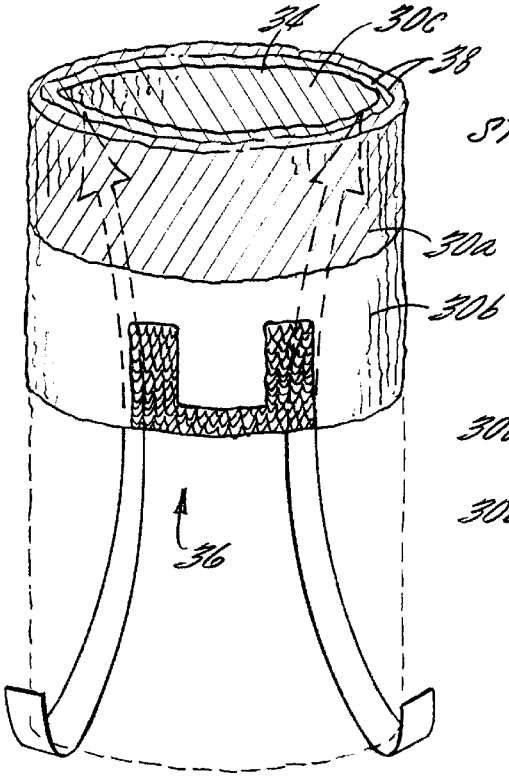
FIG. 4 is a perspective view of the blank of FIG. 3 as it appears when folded axially upon itself according to a method of making the band of FIG. 1.
Figure 7:
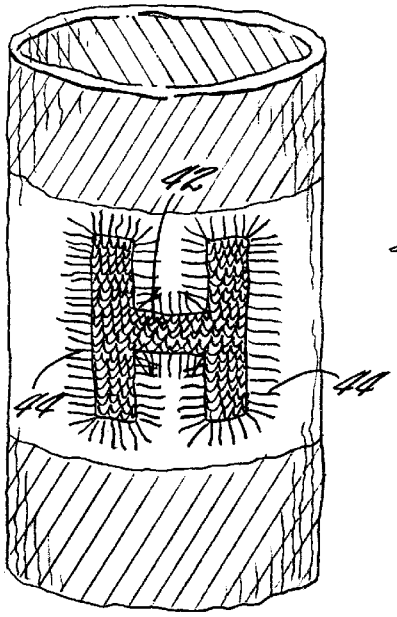
FIG. 7 is an "inside out" perspective view of the blank of FIG. 3.
Figure 6:
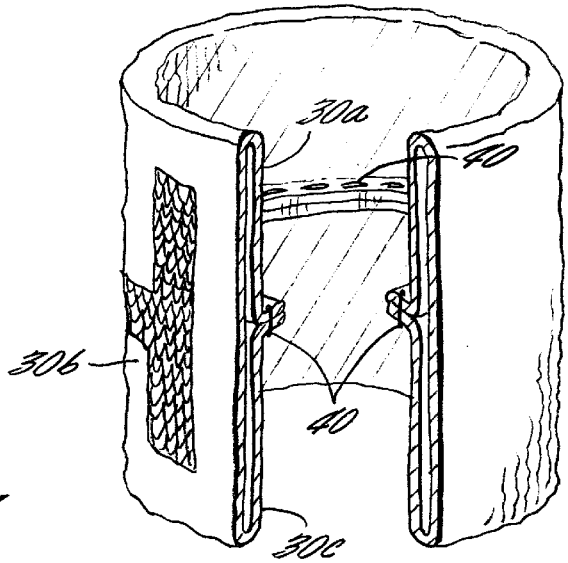
FIG. 6 is a partial cut-away perspective view of the blank of FIG. 5, as it appears with the seam positioned toward a central portion of the inner tube.

FIG. 7 illustrates the band blank 30 of FIG. 3 as it appears in "inside out" form. As described above, the yarns which are presented but not selected by the pattern mechanism at particular needles form floats 42 along the technical rear or "wrong" side of the fabric. In conventional knit fabrics which have yarn floats along the technical rear of the fabric, the length of the yarn floats generally has to be limited because the floats have a tendency to become snagged. As a result, knit fabric manufacturers are often forced to tuck a floated yarn mid-float, in order to shorten the effective float length. This tuck forms a defect in the finished fabric, and thus is often undesirable. In the bands according to the instant invention, however, the floats can be positioned internally of the finished band where they are sheltered from snagging. In this way, it has been found that intricate designs can be formed without the designer having to design around the snagging tendency of the floats. Where certain yarns are fed in for only a small number of wales in a particular portion of the tubular structure, they need not float around the rest of the entire circumference. As shown in FIG. 7, such yarns can be cut to form free yarn ends 44 which extend outwardly from the design on the rear face of the fabric. These free yarn ends 44 are, like the floats, located internally on the band 10, where they are not visible when the band is worn. Although, as discussed above, the float length is less restricted than in some applications due to its internal position, the use of the free ends 44 results in reduced yarn input, band bulk, and the tendency for extremely long floats to limit the extensibility of the band.

Figure 8:
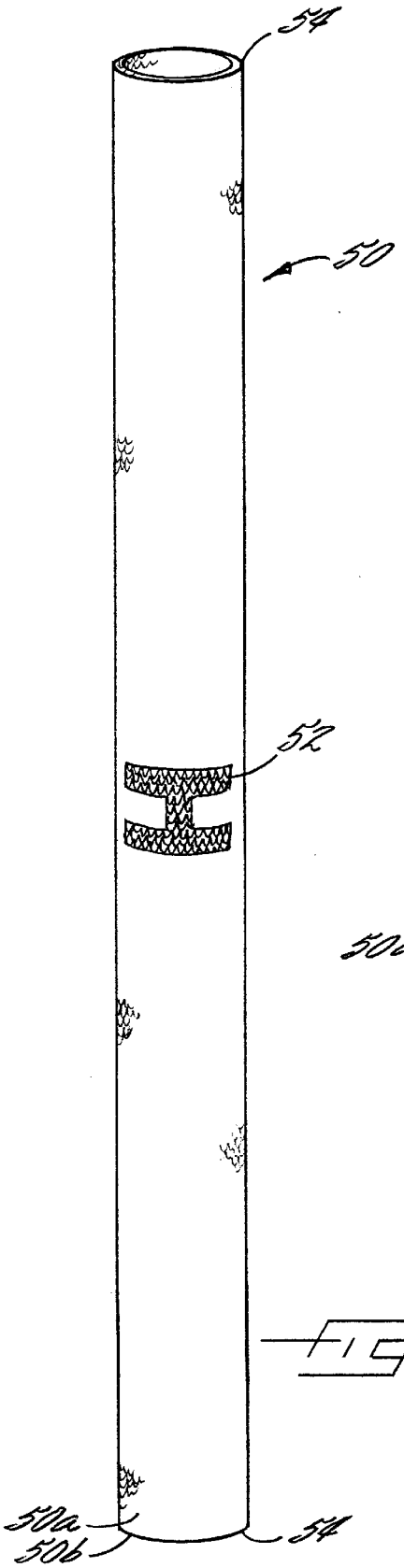
FIG. 8 is a perspective view of a blank used to form an alternative embodiment of the invention.
Figure 9:
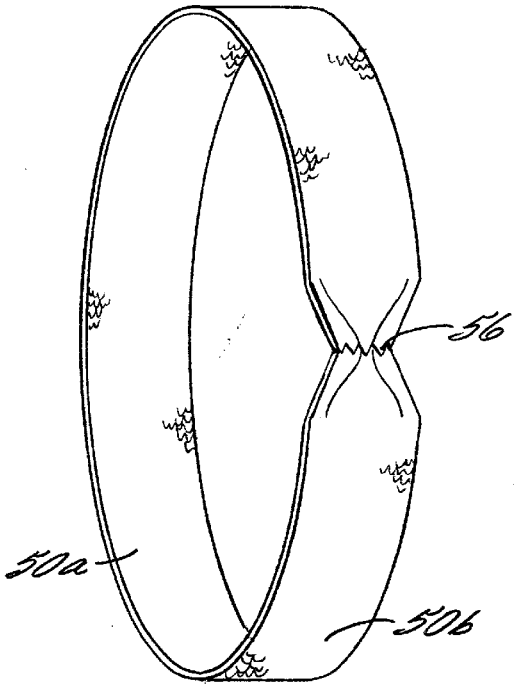
FIG. 9 is a perspective view of an alternative embodiment of the invention made using the blank of FIG. 8.

Another method of making an athletic band according to the instant invention is illustrated in FIGS. 8 and 9. A relatively small diameter tubular structure is jacquard knit in the manner described above to form a band blank 50 having integrally formed designs 52. The band blank 50 can be knit to a length approximating that desired for the circumference of the completed athletic band, or can be knit as a continuous tube which is cut to the desired band length. Alternatively, the band blanks can be knit in series using conventional mass-production methods for knit products.

In order to produce a performance version of the athletic band of this embodiment, a number of wales forming a front face 50*a* of the band blank 50 (i.e. the wales along a portion of the tubular circumference of the blank) can be knit from a specialty yarn such as those described above, while a rear face 50*b* can be knit from a different type or types of yarns, in order that a wearer-contacting surface of the finished band will have enhanced performance characteristics such as increased absorption or thermal capabilities. Alternatively, the rear face 50*b* or the entire blank 50 could be knit from specialty yarns.

In a similar manner, a number of wales forming a front face 50*a* of the band blank can be knit to include a first design pattern, while the rear face 50*b* could be knit to have the same pattern or a different pattern, depending on the desires of the manufacturer. In this embodiment of the invention where each of the front and rear faces 50*a*, 50*b* forms substantially one half of the circumference of the band blank 50, the band can be knit to be reversible by providing each face with a different design, thereby enabling two ornamental appearances to be provided by the same athletic bank.

The band blank 50 is then folded and the respective blank ends 54 are secured together along a seam 56 in a conventional manner, such as by sewing. In order to enhance the appearance of the juncture of the two blank ends 54, they can be folded as illustrated, gathered, or the like during the seaming operation to thereby form a tapered juncture. Because this construction method can readily be used to make relatively larger circumference bands, it has been found to be particularly useful in the manufacture of headbands.

In the drawings and specification, there have been disclosed typical preferred embodiments of the invention and, although specific terms are employed, these terms are used in a descriptive sense only and not for purposes of limitation. The invention has been described in considerable detail with specific reference to various illustrated embodiments. It will be apparent, however, that various modifications and changes can be made within the spirit and scope of the invention as described in the foregoing specification and defined in the appended claims.

It is claimed:

1. A method of making an athletic band comprising the steps of:

knitting a first series of courses from a first yarn on a circular knitting machine to form a first tubular section, knitting to said first tubular section a second series of courses forming a second tubular section, wherein adjacent wales in at least one course of said second series of courses are knit from visually distinct yarns so as to form at least one individual course which varies in appearance along its length, knitting to said second tubular section a third series of courses from a third yarn to form a third tubular section, wherein the yarns forming the first and third tubular sections comprise a specialty yarn selected from the group of thermal regulating and wicking yarns, axially aligning the tubular sections such that at least a portion of said first tubular section overlies at least a portion of said third tubular section, and securing a free end of said first tubular section proximate a free end of said third tubular section, to thereby form a multi-layered patterned athletic band.

2. A method according to claim 1, wherein said second section has a tubular length which is greater than that of each of the first and third tubular sections.

3. A method according to claim 2, wherein said second section has a tubular length which is approximately two times that of each of the first and third tubular sections.

4. A method according to claim 1, wherein said step of securing a free end of said first tubular section proximate a free end of said third tubular section defines a seam, and further comprising the step of positioning the seam proximate a central portion of said second tubular section.

5. An athletic band comprising:

a jacquard knit outer tube having at least one knitted course which has adjacent wales knit from visually distinct yarns, to thereby form an integral design therein, and an inner tube axially nested within said outer tube and integrally knit thereto to define a ring shaped pocket therebetween, wherein said inner tube comprises a specialty yarn selected from the group consisting of thermal regulating and wicking yarns.

6. The athletic band according to claim 5, wherein said inner tube is jacquard knit to include at least one course which has adjacent wales knit from visually distinct yarns, to thereby form an integral design therein.

7. The athletic band according to claim 5, further comprising a seam located proximate a central portion of said inner tube.

8. The athletic band according to claim 5, further comprising a seam extending through said inner and outer tubes and substantially across the width of said ring-shaped pocket.

9. The athletic band according to claim 5, wherein said design is incorporated in substantially the entire surface of said outer tube.

10. A method of making an athletic band comprising the steps of:

knitting a series of courses on a circular knitting machine to form a tubular structure, wherein predetermined sections of at least one course of said series are knit from a visually distinct yarn from a yarn forming an adjacent section so as to form at least one individual course which changes appearance along its length and such that a lengthwise extending portion of said tubular structure comprises a specialty yarn selected from the group consisting of wicking and thermal regulating yarns, folding the tubular structure widthwise upon itself such that the first and second ends of the tubular structure are substantially aligned, and securing a first end of the tubular structure to a second end of the tubular structure to form a substantially coursewise extending seam, to thereby form a multi-layered patterned athletic band.

* * * * *